United States Patent [19]

Sable

[11] Patent Number: 4,522,368

[45] Date of Patent: Jun. 11, 1985

[54] CLOSURE DEVICE

[76] Inventor: Donald E. Sable, 4100 Spring Valley Rd. #900, Dallas, Tex. 75240

[21] Appl. No.: 562,821

[22] Filed: Dec. 19, 1983

[51] Int. Cl.[3] ..... E21B 33/02

[52] U.S. Cl. ..... 251/1 B; 251/88; 166/84; 277/30

[58] Field of Search ..... 251/1 B; 166/84, 82; 277/110, 116.2, 117–122, 190, 191

[56] References Cited

U.S. PATENT DOCUMENTS

| | | | |
|---|---|---|---|
| 1,985,327 | 12/1934 | Parks | 166/82 |
| 3,290,427 | 12/1966 | Newcomer | 277/110 X |
| 4,289,294 | 9/1981 | McLean | 251/62 |
| 4,345,766 | 8/1982 | Turanyi | 277/30 |

FOREIGN PATENT DOCUMENTS

| | | | |
|---|---|---|---|
| 578431 | 10/1977 | U.S.S.R. | 166/84 |

*Primary Examiner*—Samuel Scott
*Assistant Examiner*—Allen J. Flanigan

[57] ABSTRACT

A closure device connectible to a well head through which the polished rod of a rod string extends into a well tubing for operating pump means for moving well fluids to a surface flow conductor, the closure device having a tubular ram provided with a packing or plug for closing an annular passage between the polished rod and a tubular body connected to the well head above a lateral port of the tubular body, the tubular ram and the tubular body having thread means for moving the plug between an operative lower position wherein it closes the annular passage when the rod string is stationary and on inoperative upper position; seal means between the ram and the polished rod spaced above the plug; and a plurality of independent seal means between the ram and the tubular body operative when the plug is in its inoperative position. The plug of the closure device is especially adapted to operate under high temperature and pressure conditions of the well, as during steam injection operations when the rod string is stationary, to protect the seal means from high pressures and temperatures as well as any fluids which may be corrosive or otherwise deleterious to the substance of which the seal means are made.

6 Claims, 7 Drawing Figures

CLOSURE DEVICE

This invention relates to closure devices and more particularly to closure devices for well heads.

Well head closure devices of the type illustrated and described in the U.S. Pat. Nos. 4,286,791 and 4,289,294 to Douglas K. McLean were designed for applications wherein the closure device is in closed position for prolonged periods of time during which stimulation operations, such as steam injection of a producing earth formation through a flow conductor of the well head into the well tubing, cause the closure packing or plug of the device to be subjected to high temperatures and high pressures. Such applications therefore limit the substances of which the plug is formed to those which can withstand such high temperatures and high pressure. Plugs or seals formed of such substances must be compressed with relatively great force by a tubular ram to effect the required seal between a polished rod of a rod string and a tubular body secured to the well head through which the rod extends into the well head when the polished rod is stationary.

Such closure devices, which when in inoperative position permit reciprocatory movement of a polished rod of a rod string which operates a pump means for moving the well fluids from the well, must have seal means which seal between such reciprocating polished rod and the tubular operator or ram of the closure device and also between such ram and such tubular body when the polished rod is reciprocally movable to pump well fluids to such flow conductor. Such seal means since they are not subjected to extremely high pressures and temperatures may be formed of substances which will permit reciprocatory movement of the polished rod relative to ram and of the ram relative to the tubular body while effectively sealing therebetween to prevent escape of well fluids therepast.

The closure devices heretofore in use, such as described in the above referenced U.S. Letters Patent are of complicated expensive structure and in many cases their various seal and packing means are difficult to adjust or replace.

Accordingly, an object of this invention is to provide a new and improved closure device which is of relatively simple inexpensive structure.

Another object is to provide a closure device, of the type described, wherein the shut off closure seal or plug is of a substance which can withstand high temperatures and pressures and must be compressed with relatively great force to effect the desired seal and wherein the other seal means of the closure device are made of different substances and require less complicated supporting structures.

Still another object is to provide a closure device, of the type described, wherein the ram does not impart any rotational force to the plug when it is being moved between its operative and inoperative positions to prevent abrasion or damage to the polished rod or to the tubular body at the locations at which the plug is in forced sealing engagement therewith.

Briefly stated, the closure device having these advantages has a tubular main body which is mountable on a well head through which a polished rod may extend into the well tubing of the well head, the main body having an annular seal seat facing upwardly and toward the polished rod, and a tubular operator ram having a replaceable annular seal or plug compressible against the seal seat, the operator ram being tubular and adapted to have the polished rod reciprocate therein. The operator ram itself is longitudinally movable in the main body and is movable longitudinally therein by rotation relative thereto by co-engageable threads on the ram and the main body so that the plug may be radially compressed into sealing engagement with the seal seat of the main body and with the polished rod to withstand high pressure and temperatures during the injection of steam into the well through a flow conducting opening to the well tubing below the plug.

A packing is mounted on the operator ram to seal between the polished rod and the ram while allowing reciprocal movement of the polished rod when the operator ram is in its operative position.

The seal between the operator ram and the tubular main body is provided by a plurality of longitudinally spaced, independently functioning O-rings or quad rings so that if a first lower ring fails because of damage or deterioration, the next higher O-ring or quad ring seals between the ram and the main body.

Additional objects and advantages of the invention will be understood more fully from the following description taken in connection with the accompanying drawings wherein.

Figure 1:
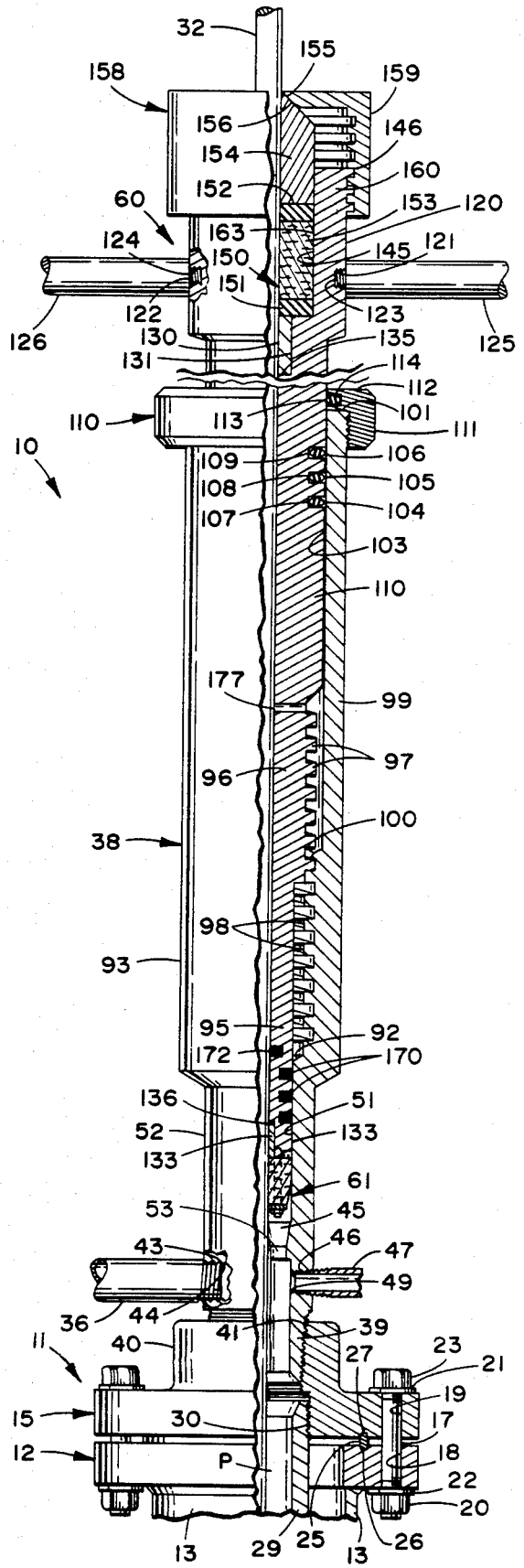
FIG. 1 is a vertical sectional view partly in elevation and partly in section of one form of a closure device embodying the invention.

Referring now to FIGS. 1 through 4 of the drawings, the closure device 10 embodying the invention is illustrated in position on a well head 11, having a bottom flange 12 attached to a well head casing, tubing or the like 13, as by welding, and an upper flange 15 coaxially aligned with and atop the lower flange and secured thereto in any suitable manner, as by a plurality of spaced bolts 17 which extend through aligned pairs of apertures 18 and 19 of the bottom and top flanges, respectively, and nuts 20 threaded on the outer ends of the shanks of the bolts. Suitable washers 21 and 22 are interposed between the bolt heads 23 and the top flange and between the nuts 20 and the bottom flange.

A metal seal ring 25 is seated in aligned annular facing recesses 26 and 27 of the bottom and top flanges, respectively, and seals therebetween. The top end of a well tubing 29 is threaded, as at 30, in the lower portion of the bottom flange. The well tubing extends downwardly in the well casing 13 and is in communication at its lower end portion with one or more well fluid producing earth formations.

A polished rod 32 extends downwardly through the well tubing and constitutes the top end section of a rod string which is connected at its bottom end to a pump connected to the well tubing 29. Alternately, the rod string below the well head may be provided with swabs spaced along its length which are engageable with the internal surfaces of the well tubing which move the well fluids upwardly through the tubing as the rod string is reciprocated. In either case, reciprocation of the rod string moves well fluids upwardly from the producing earth formation through the well tubing 29. The top end of the polished rod is of course connected to a suitable drive means, such as a horse head beam, for imparting vertical reciprocatory motion to the rod string, as is well known to those skilled in the art.

The closure device 10 embodying the invention for controlling the flow of well fluids from the top end of the well tubing to a surface flow conductor 36, includes a tubular main body 38 whose bottom end portion 39 is externally threaded and is threaded in the upstanding internally threaded boss 40, as at 41, of the top flange 15.

The threaded end portion 43 of the flow conductor 36 is threaded in a lateral port 44 of the main body located below an internal seal seat 45 of the main body. If desired, a sampling flow conductor 47 of smaller internal diameter than the surface flow conductor may have its threaded end portion 46 threaded in a port 49 of the main body also located below the seal seat 45.

The seal seat 45 is frusto-conical in shape, its diameter decreasing from its juncture with the internal surface 51 of an intermediate portion 52 of the main body 38 above the seal seat to its juncture with the top end of the vertical annular internal surface 53 of an internal annular flange of the main body.

The flow of well fluids from the top end of the well tubing to the conductors 36 and 47 is controlled by a cylindrical operator ram 60, telescoped in the main body, to whose bottom end is secured a packing assembly or means 61 which may include a somewhat resilient compressible packing or plug 62, which may be formed of any suitable substance which will provide the desired sealing between the main body seal seat 45 and the surface of the polished rod, to close or shut off the vertical annular passage between the main body and the polished rod above the conductors 36 and 37 and thus prevent flow of fluids therethrough.

The packing or plug 62 is formed of a seal substance which may be formed of metallic, ceramic or asbestos fibers or any other substances which will withstand the temperatures and chemical substances to which the plug will be subjected during use as when steam is being injected into the well tubing through the surface flow conductor 36.

Figure 2:
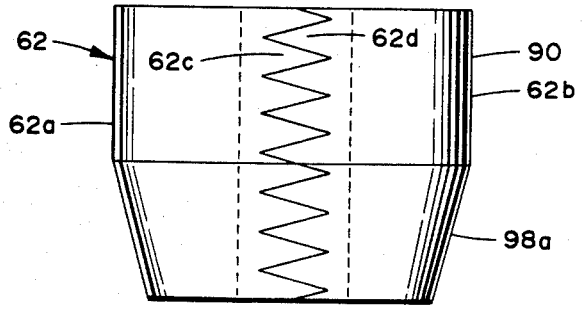
FIG. 2 is an enlarged plan view of a plug of the device illustrated in FIG. 1.
Figure 3:
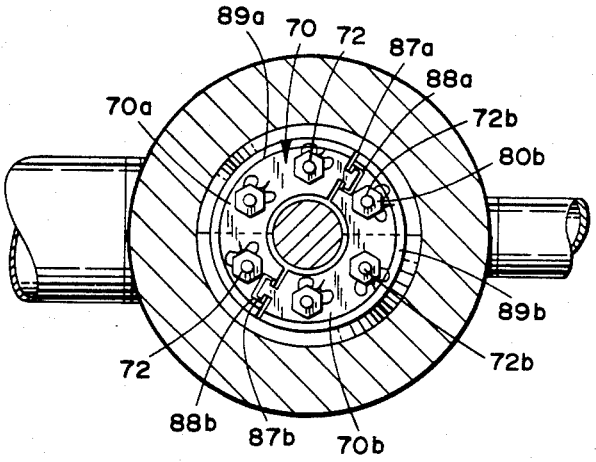
FIG. 3 is an enlarged transverse sectional view of the plug assembly of the closure device.
Figure 4:
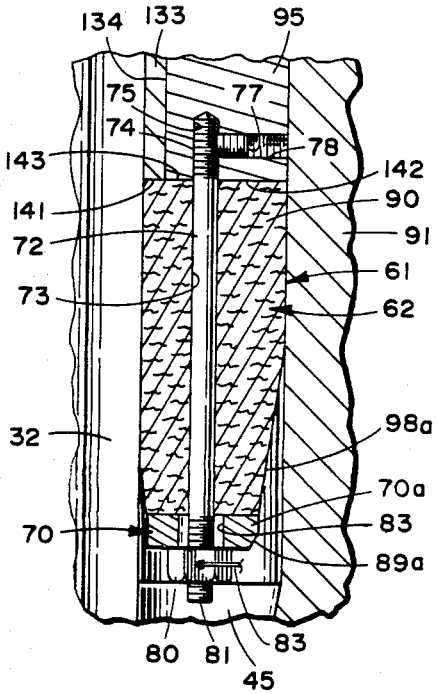
FIG. 4 is a fragmentary partly sectional enlarged view of a portion of the device of FIG. 1.

Referring now particularly to FIGS. 2, 3 and 4, the packing or plug 62 may consist of axially aligned split havles 62*a* and 62*b* which may have interdigitated portions 62*c* and 62*d*, respectively, at their longitudinal axial edges.

The plug 62 is secured to the bottom end of the operator ram by an annular retainer plate 70 formed of two semi-circular sections 70*a* and 70*b*.

The section 70*a* is secured to the operator ram by three tie rods 72. The tie rods extend through longitudinal bores 73 in the plug and have upper threaded end portions 74 threaded in downwardly opening bores 75 in the bottom end of the operator ram. Set screws 77 may be threaded in radial bores 78 of the operator ram communicating at their inner ends with the bores 75 to hold the tie rod against rotation.

Nuts 80 on the lower threaded portions 81 of the tie rods 72 limit downward movement of the retainer plate section 70*a* on the tie rods which extend through apertures 83 of the retainer plate section 70*a*. The nuts may be secured in place by tie wires 83 which extend through aligned apertures of the tie rods and the nuts.

The other retainer plate section 70*b* is similarly secured to the bottom end of the operator ram by rods 72*b* and, accordingly, corresponding elements of the tie rods 72*b* and their co-acting components have been provided with the same reference numerals, to which the subscript "b" has been added, as the tie rods 72 and their coacting components.

The apertures 84 of the retainer plate sections may be of somewhat greater radius or elongated to permit some inward and outward movement of the two retainer plate sections relative to one another and to the tie bolts which extend therethrough.

The two plate sections may also be connected for limited movement toward one another by T-shaped connector bars 87*a* and 87*b* which are disposed in T-shaped slots 88*a* and 88*b*, respectively.

The retainer plate sections 70*a* also have outer bottom downwardly and inwardly inclined semi-circular cam shoulders 89*a* and 89*b* for a purpose to be described below.

The plug 62 has an upper portion 90 of approximately the same external diameter as the internal diameter of the surface 51 of the bore of the main body extending upwardly from the top end of the seal seat 45 to a shoulder 92 defining the bottom end of an intermediate internally threaded enlarged portion 93 of the body located immediately above the main body portion 52 which extends from the threaded bottom end portion 39 of the main body.

The operator ram has a bottom portion 95 of approximately the same external diameter as the internal diameter of the portion 51 of the bore of the portion 52 of the main body and an intermediate enlarged externally threaded portion 96 thereabove whose threads 97 are engageable with the threads 98 of the main body portion 93.

The plug 62 also has a lower frusto-conical portion 98*a* which extends downwardly and inwardly from the bottom end of the annular portion 90 to the outer edge of the retainer plate 70. The outer surface of the frusto-conical portion is of substantially the same configuration and dimensions as the seat surface 45 of the main body.

The top portion 99 of the main body, extending from the internal shoulder or face 100 defining the topmost thread 98 to the top annular end surface 101 of the main body, is internally enlarged to provide an internal annular seal surface 103 above the intermediate internally threaded portion thereof which is sealingly engageable by a plurality of independently sealing seal means, such as O-rings or quad rings 104, 105 and 106 mounted in suitable longitudinally spaced external annular recesses 107, 108 and 109, respectively, of an upper intermediate section 110 of the operator ram of an external diameter greater than that of the intermediate externally threaded portion 96 of the ram and substantially equal to that of the internal diameter of the top seal portion 99 of the main body.

A closure cap 110*a* is mounted on the top end of the main body and has a cylindrical dependent portion 111 threaded on the top end of the body and a top annular internal horizontal flange 112. The flange 112 is provided with an internal annular recess 113 in which a resilient ring 114 is disposed. The ring 114, which may be an O-ring, is provided to prevent movement of dust, dirt and the like downwardly between the operator ram and the top end of the main body.

The top end enlarged portion 120 of the operator ram is provided with diametrically opposed threaded bores 121 and 122 in which are received the reduced threaded end portions 123 and 124 of a pair of straight handle bars 125 and 126, respectively, by means of which rotary motion may be imparted to the ram relative to the main body.

A top bushing 130 of a suitable somewhat soft metal, such as brass or bronze, is positioned in an enlarged upper portion 131 of the bore of the operator ram. A similar bottom bushing 133 is positioned in a downwardly opening recess or enlarged bore 134 in the bottom end portion of the operator ram, downward movement of the top bushing being limited by the internal annular upwardly facing shoulder 135 of the operator ram and upward movement of the bottom bushing being limited by the internal annular downwardly facing outer shoulder 136 of the operator ram.

Each of the bushings may comprise longitudinally split half-sections to facilitate their removal and replacement as they wear.

The bottom surfaces 141 and 142 of the operator ram and the bushing, respectively, lie in a common horizontal or transverse plane and engage the top surface 143 of the plug 62.

The top end portion 145 of the bore of the operator ram at its top end portion 120 is enlarged to form an upwardly open packing chamber 146 in which is disposed a packing assembly 150 comprising bottom and top packing retainer rings 151 and 152, a packing 153 between the retainer rings and a compression ring 154.

The compression ring 154 has an external annular upwardly and inwardly inclined cam surface 155 which is engaged by a similarly inclined annular surface 156 of a cap 158. The cap has an annular dependent flange 159 which is threaded on the threaded portion 160 of the operator ram.

The packing retainer rings and the compression ring may each be formed of split halves to facilitate their installment and replacement. The packing may be of any suitable type, either formed of a plurality of split rings or a single ribbon or strip which may be wound about the polished rod and compressed into sealing engagement with both the polished rod and the internal seal surface 163 of the operator ram defining the packing chamber 146.

In use, the main body 38 of the control device 10 is connected to the well head 11 as shown in FIG. 1. The operator ram 60 which is slidably mounted on the polished rod 32 of the rod string is then telescoped downwardly into the main body. The plug 62 being of smaller diameter than the internal diameter of the portions of the internal bore or longitudinal passage of the main body above the portion 52, moves easily therethrough. As the plug moves into the top end of the main body bore portion 52, its surface 90 may slidably engage the surface 51.

As the ram moves to the position illustrated in FIG. 1, the lower end of operator ram thread 97 engages the upper end of the internal thread 98 and further downward telescopical movement of the operator ram in the main body is accomplished by rotating the operator ram in the main body in a clockwise direction as seen in FIG. 1.

The seals 104, 105 and 108 are now in sealing engagement with the seal surface 103 preventing fluid flow between the operator ram and the main body.

The packing assembly 150 is positioned on the top end of the operator ram as shown and the packing 153 is compressed by rotation of the cap 158 downwardly on the operator ram to seal between the polished rod and the operator ram.

When the producing earth formation is to be subjected to well fluid production stimulation operations which require the closure of the annular space between the polished rod and the operator ram and of the annular space between the ram and the tubular main body to prevent flow of fluids therethrough, the operator ram 60 is moved downwardly by rotating it clockwise in the main body by means of the handles 125 and 126. As the plug 62 moves downwardly into the seal seat 45, if either the retainer plate section is not in alignment with the internal surface 53 of the flange 54, the engagement of its cam surface **89*a* or 89*b* with the seat seal 45 cams such retainer plate section into alignment and allows it to move downwardly into alignment or past the surface 53**.

Continued downward movement of the operator ram now causes the frusto-conical surface **98*a* of the plug to engage the seal seat 45** of the main body and the plug to be compressed into sealing engagement with the seal seat and the polished rod. As the plug is compressed and therefore shortened longitudinally as it is expanded radially, the tie rods slide downwardly through the plug as required, the material of the plug also being compressed into sealing engagement with the tie rods.

In this form of the closure device, the plug material is preferably one which will slide along the seal seat as it is compressed thereagainst since the plug revolves with the ram eventhough some rotational movement of the ram relative to the plug may take place since the plug is somewhat resilient.

Injection of steam under high pressure and temperature is then initiated. The polished rod is, of course, stationary during such injection.

The force with which the plug is held under compression obviously may be very great and prevent any leakage of fluids therepast even though the pressure in the well tubing may be great and the fluids present therein are at high temperatures since the substance of which the plug is made is chosen to withstand such pressures and temperatures without deterioration.

Even though the temperature of the fluids in the top portion of the annular passage P in the well tubing may rise to a very high value, the temperature at the location of the seals 104, 105 and 106 will be considerably lower due to heat dissipation throughout the length of the main body above the plug. These seals may therefore be formed of a substance which need not withstand as high temperature as the substance of which the plug 62 is formed.

It is found that O-rings or quad rings formed of a substance commercially available under the trademark EBOLON from the Chicago Gasket Company are satisfactory for use in closure devices used to shut off flow through the well tubing during steam injection operations during which the temperatures of the well fluids at the top end of the well tubing may rise to 650 degrees Fahrenheit. Seals formed of this substance, a composition of Teflon filled with glass, metal, or othe reinforcing material, can withstand temperatures exceeding 500 degrees Fahrenheit without deterioration.

It is to be noted that neither the seals 104, 105 and 106 nor the packing 153 are subjected to the high pressures to which the plug 62 is subjected during its shut-in or closed position since the plug 62 closes both the annular passage between the polished rod 32 and the operator ram and the annular passage between the main body and the operator ram.

Once the injection of steam through the surface conductor 36 is stopped and fluids are allowed to flow from the top end of the tubing to and throught the flow conductor 36, the fluid pressure drops and the ram may be moved upwardly to free the polished rod for reciprocal movement.

Subsequent to the heating of the well fluid producing earth formation by injection of steam thereinto, which reduces the viscosity of the well fluids to a value at which they can be pumped upwardly through the well tubing by a pump or swabs by reciprocation of the rod string of which the polished rod comprises the top section and the movement of the ram to open position, the packing 153 becomes functional to prevent flow of the pumped well fluids upwardly between the polished rod and the operator ram and one of the seals 104, 105 and 106 becomes functional to prevent flow of the pumped well fluids between the operator ram and the main body.

As is well known to those skilled in the art, the lowermost seal, 104 if it is in operative condition, will seal between the operator ram and the main body when the pressure therebelow is greater than thereabove. Since the lowermost seal is operational, the greater pressure therebelow between the operator ram and the main body is not transmitted therepast and the next higher seal 105 is not subjected thereto.

It will thus be seen that the seals 104, 105 and 106 are independent, that the seal 104 functions first unless and until it fails, whether due to deterioration because of temperature and/or chemical action thereon of the well fluids or due to mechanical forces or wear. In case of failure of the seal 104 for whatever reason, the next higher seal 105 becomes operational to prevent flow of well fluids therepast between the operator ram and the main body. Similarly, the top seal 106 becomes operational if the seal 105 subsequently fails.

It will thus be apparent that a plurality of independent seals such as the rings 104, 105 and 106 between the operator ram and the main body are provided as a safety measure and to prolong the period of time between required replacement of the seal means between the operator mandrel and the main body. In this connection, it is to be noted that movement of the operator ram relative to the main body occurs only during opening and closing movements of the operator ram in the main body which may occur at intervals of several days or weeks and thus the independent seals are not subjected to severe wear due to such movement.

The polished rod, however, is continuously reciprocally moved relative to the operator ram for prolonged periods of time when the operator ram is in open position and the well fluids are being pumped through the well tubing to the surface flow conductor 36. As a result, the packing 153 is subject to wear. The packing 153, however, can be periodically recompressed by rotation of the cap 158. The packing 153 can also be easily replaced by unscrewing the cap 158, removing the split havles of the compression ring 154 and the split halves of the top retainer ring 152. The worn packing may then be removed from the packing chamber and replaced by new packing. The new packing may be in the form of a ribbon or strip which may be wound about the polished rod and pushed into the packing chamber. Alternately, the packing may be in the form of split rings which may be disposed about the polished rod and then pushed down into the packing chamber. The split halves of the top retainer ring and then the split halves of the compression ring are replaced and the compression cap screwed back on the top end of the operator mandrel. In this manner the seal means between the polished rod and the operator ram may be replaced without disconnection of the operator ram from the polished rod or the main body.

To prevent movement of viscuous well fluids between the ram portion 95 and the lower portion 52 of the main body upwardly past the shoulder 92 and the main body, or carried on the outer surface of the ram portion 95 therepast as the operator ram is moved upwardly from closed to open position, wiper rings 170, of felt or the like, may be positioned in an external annular recesses of the operator ram positioned below the shoulder 92 when the ram is in its upper open position. If very viscuous material is moved into the main body portion 93 and subsequently hardens, subsequent rotational downward movement of the ram and its thread may be difficult and may require heating of the portion 93 to soften such material. A similar wiper ring 172 may be positioned in an annular recess of the operator ram above the bushing 133 to wipe such material off the polished rod as it moves upwards in the operator ram.

If desired, one or more radial ports 77 may be provided in the operator ram to equalize pressures between the interior and exterior of the operator ram so as to prevent a lowering of the pressure between the main body and the ram below the seals 104, 105 and 106 which may otherwise occur as the ram is moved upwardly from its lower closed to its upper open position. Such decrease in pressure would tend to draw well fluids past the wiper rings 170 which might then interfere with or make more difficult subsequent downward movement of the ram from its open position toward its closed position.

When the stimulation operation is completed, the operator ram is moved upwardly by rotating it in a counterclockwise manner. As the operator mandrel rotates and moves upwardly in the main body, the plug may tend to adhere to the seal seat 45 and to the polished rod, but some upward movement of the operator ram, the tie rods and the retainer plate may take place relative to the plug until the retainer plate engages the bottom surface of the plug and further upward movement of the operator ram will move the plug to its upper, inoperative position illustrated in FIG. 1. Some rotational force obviously is imparted to the plug which helps to dislodge it from the seal seat.

It will be seen that a worn packing plug 62 may be replaced without disconnecting the main body from the well head or removing the operator ram off the polished rod. This may be accomplished by loosening the packing compression cap 158, unscrewing the cap 112 of the top end of the main body, rotating the operator ram in a counterclockwise manner until its threads 97 disengage upwardly from the threads 98 of the main body and then moving it upwardly on the polished rod until the seal assembly 61 is above the top end of the main body. The nuts 80 are then unscrewed, the retainer plate and packing or plug 62, moved downwardly off the tie rods, a new plug moved upwardly on the tie rods, and the retainer plate replaced and secured on the tie rods by the nuts 80. The operator may then be telescoped back into the main body into the position illustrated in the drawing, the cap screw 112 screwed back into the main body, and the packing 153 compressed by the compression cap 158.

It will now be seen that a new and improved closure device 10 has been illustrated and described which is of relatively simple construction, is easily assembled and whose parts which are subject to wear, deterioration or damage are easily removable and replaceable without complete removal of the closure device from the well equipment to which the closure device is connected.

Figure 5:
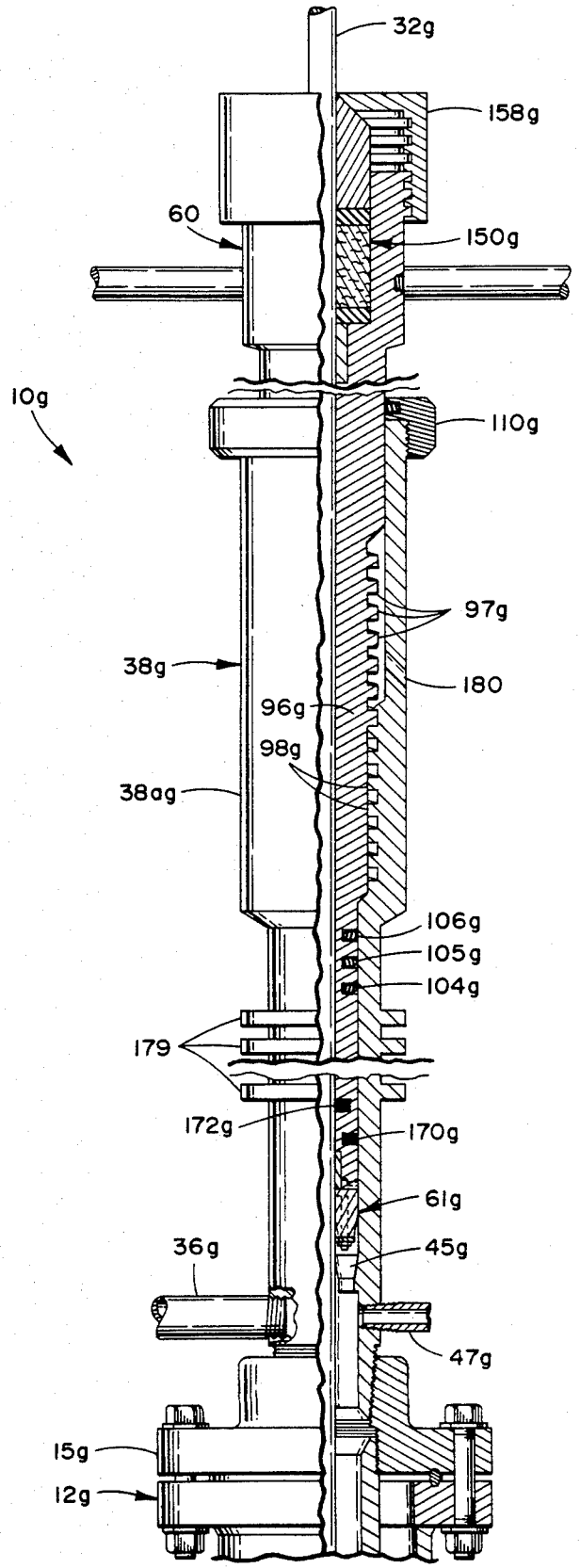
FIG. 5 is a vertical view, partly in elevation and partly in section, of another form of the closure device embodying the invention.

Referring now to FIG. 5 of the drawing, the closure device 10*g* is a modified form of the closure device 10, and accordingly its elements have been provided with the same reference numbers, to which, the subscript "g" has been added, as the corresponding elements of the control device 10.

The closure device 10*g* differs from the control device 10 in that the independent seals 104*g*, 105*g* and 106*g* are positioned on the operator ram 60 below the threads 97*g* of the operator ram and also below the threads 98*g* of the main body 38*g*. The independent seals are located well above the seal seat 45*g* so that dissipation of the heat from the main body and the operator ram creates a sufficient temperature gradient that the independent seals are at a substantially lower temperature than that of the plug 62 when the operator ram is in its lower closed position during steam stimulation operations and the independent seals will therefore not be subjected to such temperature as would cause their deterioration or failure. The distance between the lowermost seal 104*g* and the plug 62 may be increased as desired to obtain the required temperature gradient. If desired heat radiating fins or flanges 179 may be formd on the main body 38*g* to increase such temperature gradient.

The threads 97*g* and 98*g* will in this embodiment of the invention never be exposed to the tubing pressure nor to well fluids since the independent seals 104, 105 and 106 will prevent any fluid flow therepast. If desired, a vent port 180 may be provided in the main body to maintain the annular spaces between the operator ram and the main body above the seal 106*g* at atmospheric pressure even though the volume of such space will change as the operator ram is moved longitudinally in the main body during closing and opening operations of the closure device.

Figure 7:
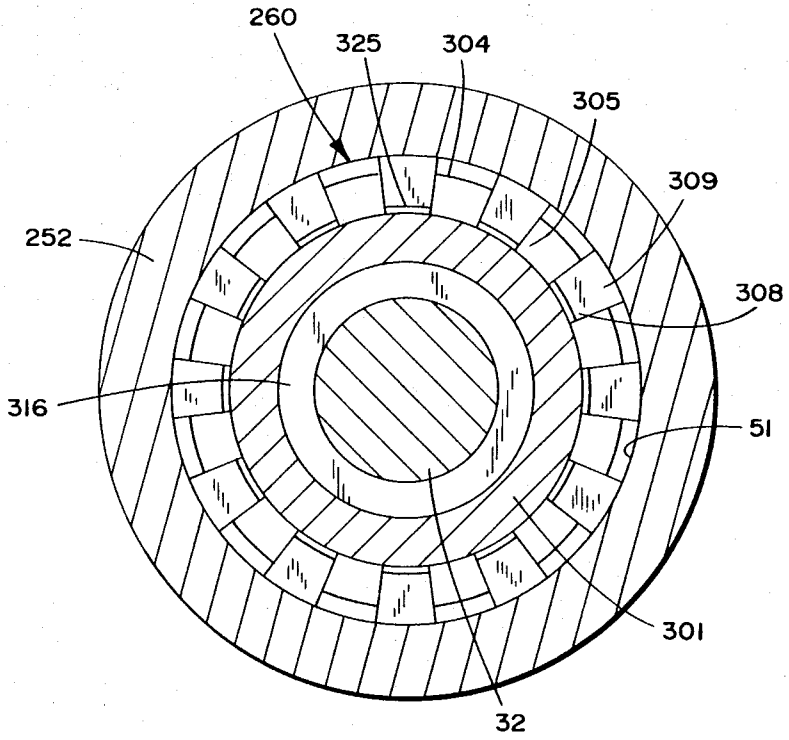
Figure 6:
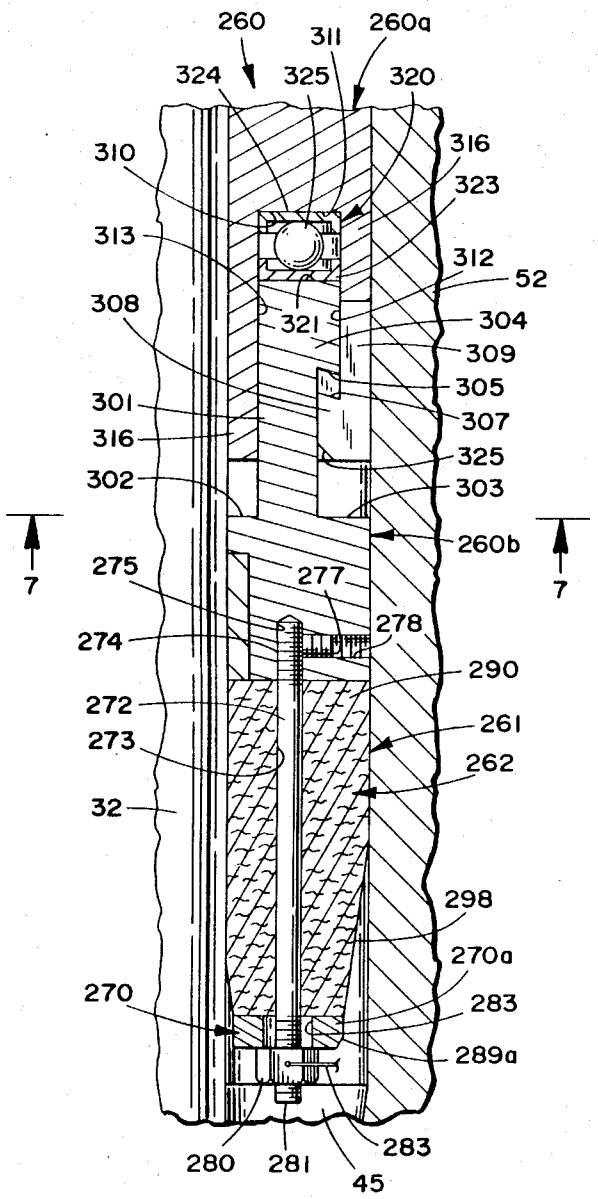
FIG. 6 is a fragmentary sectional view showing a modified form of the ram employable in either of the two embodiments of the invention illustrated in FIGS. 1 and 5; and, FIG. 7 is a sectional view taken on line 7—7 of FIG. 6.

Referring now particularly to FIGS. 6 and 7 of the drawing, the operator ram 260 is similar to the operator ram 60 and, accordingly its elements have been provided with the same reference numberals, to which the prefix "2" has been added, as the corresponding elements of the operator ram 60.

The operator ram 260 differs from the operator ram 60 in that it is formed of an upper section 260*a* and a lower section 260*b* releasably connected to one another for rotational movement relative to one another about their common central longitudinal axis.

The lower tubular operator ram section 260*b* has the packing assembly 261 mounted thereon by the same means as the packing assembly 61, i.e., by means of tie rods 272 and retainer plate 270.

The lower section 260*b* has a vertical annular connector portion 301 extending upwardly from the internal upwardly facing annular inner and outer surfaces 302 and 303, respectively.

The connector portion 301 has an annular external latch flange 304 which provides a downwardly and outwardly inclined latch shoulder 305 which is engageable by the upwardly facing shoulders 307 of the internal bosses 308 of the circumferentially spaced resilient collet fingers 309 of the top ram section 260*a*.

The collet fingers extend downwardly of the annular downwardly opening groove 310 of the upper ram defined by the downwardly facing annular surface 311 and the concentric inwardly and outwardly facing annular surfaces 312 and 313, respectively. The inner annular dependent portion 316 of the upper ram section telescopes inwardly over the connector portion 301 of the lower section with its surface 313 being adapted to slide relative to the inner surface of the connector portion. Similarly the outer dependent annular portion 316 slides over the outer annular surface of the latch flange 304. The collet fingers 309 are of course integral with and dependent from the annular portion 316.

If desired, a friction reducing means 320 may be disposed in the groove 310 between the downwardly facing surface 311 of the upper ram section and the top annular surface 321 of the lower ram section connector portion 301.

As schematically illustrated, the friction reducing means 320 may be a ball bearing assembly having a bottom annular race 323, a top annular race 324 and a plurality of balls 325 interposed between and held in place by the races.

The two ram sections are easily connected by telescoping the collet fingers 309 downwardly over the latch flange 304, the cam shoulders 325 of the latch bosses camming the collet fingers resiliently outwardly as they engage the top outer surface edge of the latch flange. When the collet finger bosses move downwardly of the latch shoulder 305 of the latch flange, the collet fingers move their bosses 308 resiliently inwardly to their operative positions wherein their top shoulders 307 will engage the latch shoulder or surface 305 and thus limit upward movement of the top section relative to the lower ram section.

It will be apparent that when the operator ram 260 is telescoped downwardly into the longitudinal passage of the main body 38, and the lower ram section 260*b* enters into engagement with the internal surface 51 of the main body portion 52, the collet fingers will be locked in latched position illustrated in the drawing.

When it is needed to move the packing assembly 261 to its operative position, clockwise rotation of the upper portion 260*a* of the ram will move the plug 262 into engagement with the seal seat 45. Further downwardly and rotational movement of the upper ram section 260*a* will now cause the plug or packing 262 to be compressed longitudinally as both ram sections will be moved downwardly relative to the packing or plug even though the rotation of the plug is stopped as it is moved and compressed into sealing engagement with the polished rod 32 and the seal seat 45. The upper ram section will of course rotate relative to the bottom ram section during further downward movement of the ram sections 260*a* and 260*b* as the packing or plug is compressed.

It will be seen that the bearing assembly 320 will facilitate such rotation of the upper ram section relative to the lower ram section as the lower ram section is forced downwardly in the main body due to the downward movement of the ram in the main body due to the downward movement of the ram in the main body caused by the engagement of the threads of the operator ram and the main body as described above.

When it is necessary to move the packing or plug to its inoperative position wherein the plug is not in compressed engagement with the polished rod so that the rod is free to be moved reciprocably, the upper operator ram section is moved upwardly as it is rotated counterclockwise. As the upper ram section moves upwardly, the top shoulders 307 of the collet bosses will engage the shoulder 305 of the flange 304 of the lower ram section and further upward movement of the upper latch section will cause the lower ram section to move upwardly therewith. If the packing or plug resists rotational movement due to the rod or the seal seat the upper ram section may rotate relative to the lower ram section, the top shoulders or surfaces 307 of the collect bosses sliding rotationally relative to or against the latch flange shoulder or surface 305 of the lower ram section.

The collet bosses are cammed inwardly against outward displacement due to the downward and outward slope of the shoulders 307 and 305. In addition, of course, if these shoulders were not so inclined the collet fingers would be still locked in against outward movement relative to the latch flange due to the engagement of their outer surfaces with the internal surface 51 of the main body.

As upward movement of the lower ram section is continued with the tie rods 272 and the retainer plate 270 moving upwardly relative to the plug 262, the plug will be moved forceably upwardly as the retainer plate engages the bottom surface of the plug and thus freed from the seal seat and the polished rod.

It will now be seen that a new and improved closure device for well heads has been illustrated and described for preventing fluid flow between an elongate member, such as a polished rod 32, and a tubular body through which the elongate member extends such as the main body 38, the closure device having a plug or packing adapted to withstand high pressures and temperatures preventing such fluid flow when the rod is stationary and with seal means which permit reciprocating movement of the rod while effectively sealing between the rod and the tubular member when the plug is in inoperative position and the temperature and pressure to which such seal means are subjected are decreased.

It will further be seen the closure device includes a tubular ram disposed in the main or tubular body and about the rod, the plug being compressible on downward movement of the ram relative to the tubular body to engage the rod and the tubular body and seal therebetween when the rod is stationary.

It will also be seen that the ram is provided with a first seal means for sealing between the ram and the polished rod while permitting reciprocatory movement of the rod relative to the ram and with second seal means for sealing between the ram and the tubular main body while allowing rotational and longitudinal movement of the ram relative to the tubular main body.

It will also be seen that the second seal means can include a plurality of independent separate seal means spaced longitudinally relative to the ram and the main body so that failure of one such independent seal means merely causes another seal means to become operative and prevent fluid flow between the main body and the ram.

It will further be seen that the first seal means is adjustable. to make up for wear of the seal means due to the movement of the rod relative thereto.

It will also be seen that the ram may be formed of an upper section and a lower section with the lower section carrying the plug and with the upper section rotatably connected to the lower section so that the upper section may be rotated and moved upwardly to move the lower section upwardly therewith without requiring rotation of the lower section and the plug relative to the tubular main body so that the plug may be moved more easily out of operative engagement with the rod and the main body.

It will further be seen that the upper section of the tubular ram and the main body have coengagement means for moving the ram longitudinally relative to the main body upon rotation of the ram relative to the main body.

It will further be seen that the upper ram section may rotate relative to the lower ram section as it is moved downwardly to permit compression of the plug without causing it to rotate.

The foregoing description of the invention is explanatory only and changes in the details of the construction illustrated may be made by those skilled in the art, within the scope of the appended claims without departing from the invention.

What I claim and desire to secure by Letters Patent of the United States is:

1. A closure device for a well head having a substantially vertical flow conductor extending into a well bore and an elongate member extending longitudinally into said vertical flow conductor, said closure device including: a tubular main body connectible to said well head in axial alignment with the vertical flow conductor for and with the elongate member to extend therethrough into the well head and the well flow conductor, said main body having lateral port means above the well head and a seal seat above said port means; a tubular operator ram telescoped downward in said main body and extending toward said seal seat, annular compressible seal means mounted on said operator ram engageable with said seal seat upon downward movement of said operator ram in said main body and compressible between said operator ram and said seal seat for engaging and sealing between the elongate member and said main body while the elongate member is stationary when said operator ram is moved downwardly in said main body toward said seal seat; co-engageable means on said operator ram and said main body above said seal seat for moving said operator ram longitudinally in said main body upon rotation of said operator ram relative to said main body, first seal means disposed above said seal seat for sealing between said operator ram and said main body; and second seal means disposed above said compressible seal means for sealing between the elongate member and said operator ram, said first seal means comprising a plurality of longitudinally spaced independent seal means, said co-engageable means being disposed between said seal seat and said first seal means, said operator ram comprising an upper section and a lower section connected rotatably to said upper section, one of said upper sections and said lower section having a plurality of collet fingers, the other of said sections having a lock flange, and co-engageable latch means for limiting upward movement of said upper section relative to said lower section while permitting rotational movement of said upper section relative to said lower section.

2. The closure device of claim 1, and friction reducing means between said upper section and said lower section operative when said upper section is moved downwardly in said main body.

3. The closure device of claim 2, and wiper means between said operator ram and said main body between said seal seat and said co-engageable means.

4. The closure device of claim 3, and wiper means on said ram above said compressible seal means for engaging the elongate member.

5. The closure device of claim 1, and wiper means between said operator ram and said main body between said seal seat and said co-engageable means.

6. The closure device of claim 5, and wiper means on said ram above said compressible seal means for engaging the elongate member.

* * * * *